US005672456A

United States Patent [19]

Chamberlain et al.

[11] Patent Number: 5,672,456

[45] Date of Patent: Sep. 30, 1997

[54] LIQUID DEVELOPER COMPOSITIONS

[75] Inventors: Scott D. Chamberlain, Macedon; David H. Pan, Rochester; John W. Spiewak, Webster, all of N.Y.

[73] Assignee: Xerox Corporation, Stamford, Conn.

[21] Appl. No.: 778,855

[22] Filed: Jan. 6, 1997

[51] Int. Cl.[6] ..... G03G 9/135

[52] U.S. Cl. ..... 430/115

[58] Field of Search ..... 430/115

[56] References Cited

U.S. PATENT DOCUMENTS

| | | | |
|---|---|---|---|
| 5,030,535 | 7/1991 | Drappel et al. | 430/116 |
| 5,302,195 | 4/1994 | Helbrecht et al. | 106/25 R |
| 5,308,731 | 5/1994 | Larson et al. | 430/115 |
| 5,318,883 | 6/1994 | Yamanaka et al. | 430/110 |
| 5,366,840 | 11/1994 | Larson et al. | 430/115 |
| 5,501,934 | 3/1996 | Sukata et al. | 430/110 |
| 5,563,015 | 10/1996 | Bonsignore et al. | 430/106 |
| 5,585,216 | 12/1996 | Baur et al. | 430/110 |

*Primary Examiner*—Roland Martin
*Attorney, Agent, or Firm*—E. O. Palazzo

[57] ABSTRACT

A positively charged liquid developer comprised of a nonpolar liquid, thermoplastic resin, a cyclodextrin charge control additive, pigment, and a charge director comprised of a nonpolar liquid soluble organic aluminum complex, or mixtures thereof of the formulas

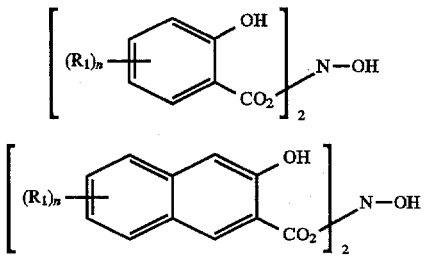

II wherein $R_1$ is selected from the group consisting of hydrogen and alkyl, and n represents the number of R substituents.

25 Claims, No Drawings

LIQUID DEVELOPER COMPOSITIONS

PATENTS AND PENDING APPLICATIONS

U.S. Pat. No. 5,563,015, the disclosure of which is totally incorporated herein by reference, illustrates a positively charged liquid developer comprised of a nonpolar liquid, thermoplastic resin particles, an optional charge adjuvant, optional pigment, and a charge director comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

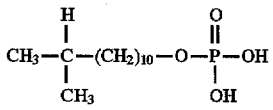

mono

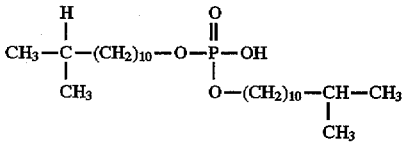

di wherein $R_1$ is selected from the group consisting of hydrogen and alkyl, and n represents a number.

U.S. Pat. No. 5,627,002, the disclosure of which is totally incorporated herein by reference, illustrates liquid developers with cyolodextrin charge additives, and copending application U.S. Ser. No. 778,990 pending, disclosure of which is totally incorporated herein by reference, illustrates a liquid developer with a charge additive of PPO:PEO.

BACKGROUND OF THE INVENTION

This invention is generally directed to liquid developer compositions and, more specifically, the present invention relates to a liquid developer containing certain charge directors. More specifically, the present invention relates to positively charged liquid developers comprised of charge directors of organic aluminum complexes of the following formulas

II.

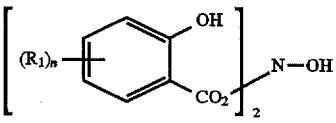

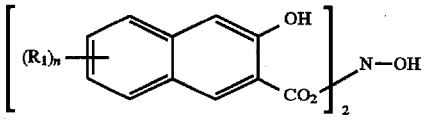

wherein $R_1$ is selected from the group consisting of hydrogen and alkyl; wherein alkyl, for example, contains from 1 to about 12 carbon atoms, and n represents a number, such as 1, 2, 3, or 4; and wherein the preferred aluminum complex in embodiments is an aluminum-di-tertiary-butyl salicylate, or Alohas. The developers of the present invention can be selected for a number of known imaging systems, such as xerographic imaging and printing processes, including charged area development wherein latent images are rendered visible with the liquid developers illustrated herein.

For image quality, solid area coverage and resolution of developed images one usually desires, for example, sufficient toner particle electrophoretic mobility. The mobility for effective image development is primarily dependent on the imaging system used, and this electrophoretic mobility is directly proportional to the charge on the toner particles effected by the charge director selected, and inversely proportional to the viscosity of the liquid developer fluid. For example, an about 10 to 30 percent change in fluid viscosity caused for instance by an about 5° C. to 15° C. decrease in temperature could result in a decrease in image quality, poor or unacceptable image development and undesirable image background development, for example, because of a 5 percent to 23 percent decrease in electrophoretic mobility. Insufficient particle charge can also result in poor, or no transfer of the developer or toner to paper, or other substrates. Poor transfer, for example, can result in poor image solid area coverage if insufficient toner is transferred to the final substrate and can also result in image defects such as smearing and hollowed fine features. To overcome or minimize such problems, the liquid toners of the present invention were arrived at after substantial research efforts, and which toners possess a positive charge, and result in, for example, sufficient particle charge, for excellent image transfer and maintaining the mobility within the desired range of the particular imaging system employed. Advantages associated with the developers of the present invention include a positive charge on the developer particles, excellent improved ROD thereby enabling excellent color image resolution and high color intensity for extended time periods. The greater toner charge results in, for example, improved image development and higher quality images, such as higher resolutions with less background deposits.

PRIOR ART

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin, optional pigment, and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 μm (microns) average by area size as measured with the Horiba 700 Particle Sizer.

Since the formation of proper images depends primarily on the difference of the charge between the toner particles in the liquid developer and the latent electrostatic image to be developed, it is desirable to add a charge director compound and charge adjuvants which increase the magnitude of the charge, such as polyhydroxy compounds, amino alcohols, polybutylene succinimide compounds, aromatic hydrocarbons, metallic soaps, and the like, to the liquid developer comprising the thermoplastic resin, the nonpolar liquid and the colorant. A charge director is of importance in controlling the charging properties of the toner to enable excellent quality images.

In U.S. Pat. No. 5,035,972, the disclosure of which is totally incorporated herein by reference, there are illustrated liquid developers with quaternized ammonium AB diblock copolymer charge directors, and wherein the nitrogen in the ionic A block is quaternized with an alkylating agent.

U.S. Pat. No. 5,019,477, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthenates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL® may be selected.

U.S. Pat. No. 5,030,535 discloses a liquid developer composition comprising a liquid vehicle, a charge control additive and toner particles. The toner particles may contain pigment particles and a resin selected from the group consisting of polyolefins, halogenated polyolefins and mixtures thereof. The aforementioned liquid developers can be prepared by first dissolving the polymer resin in a liquid vehicle by heating at temperatures of from about 80° C. to 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of the block copolymer is oriented to the surface of the block polymer, and the compatible segment thereof is oriented to be compatible with other resins and a coloring agent contained in the toner so that the toner is provided with both liquid-repelling and solvent-soluble properties.

In U.S. Pat. No. 4,707,429 there are illustrated, for example, liquid developers with an aluminum stearate charge adjuvant. Liquid developers with, for example, certain aluminum salicylates as charge directors are illustrated in U.S. Pat. No. 5,045,425. Also, stain elimination in consecutive colored liquid toners is illustrated in U.S. Pat. No. 5,069,995.

In U.S. Pat. No. 5,306,591 and U.S. Pat. No. 5,308,731, the disclosures of which are totally incorporated herein by reference, there is illustrated a liquid developer comprised of thermoplastic resin particles, a charge director, and a charge adjuvant comprised of an imine bisquinone; and a liquid developer comprised of a liquid, thermoplastic resin particles, a nonpolar liquid soluble charge director, and a charge adjuvant comprised of a metal hydroxycarboxylic acid, respectively.

In U.S. Pat. No. 5,366,840, the disclosure of which is totally incorporated herein by reference, there is illustrated a liquid developer comprised of thermoplastic resin particles, an optional charge director, and a charge additive or adjuvant of the formulas indicated wherein $R_1$ is selected from the group consisting of hydrogen and alkyl, and n is 0 (zero), 1, 2, 3, or 4. This patent does not specifically disclose the use of the above components as a charge director. For example, use of Alohas, an abbreviation for aluminum-di-tertiary-butylsalicylate as indicated in Example I that follows, as a charge director (CD) in positive charging inks is not believed to be known, however, the selection of Alohas in the particle as a charge control agent (CCA) is known in negative inks. Alohas alone as a charge director (CD) dissolved in the hydrocarbon continuous phase is unknown in negative inks, and it would be necessary to uncharacteristically switch the locations of both the Alohas CCA and the CD species in negative inks to achieve the complimentary charging system in positive inks. With the present invention in embodiments, there was uncharacteristically switched only the location of the Alohas CCA from the toner particles (in the negative inks) to the location of Alohas CD in the hydrocarbon continuous phase (in the invention positive inks) and not the complimentary switch of the CD in the continuous phase of the negative inks to the particle as CCA in the invention positive inks.

In U.S. Pat. No. 5,308,731, the disclosure of which is totally incorporated herein by reference, there is illustrated a liquid developer comprised of a non-polar liquid, pigment, thermoplastic resin particles, EMPHOS charge directors, and a charge adjuvant of a metal hydroxycarboxylic acid.

SUMMARY OF THE INVENTION

Examples of objects of the present invention in embodiments thereof include:

It is an object of the present invention to provide a liquid developer with many of the advantages illustrated herein. Another object of the present invention resides in the provision of a liquid developer capable of high particle charging.

Another object of the invention is to provide positively charged liquid developers wherein there is selected certain charge directors of organic aluminum complexes in combination with cyclodextrin or cyclodextrin CCA (charge control additives) derivatives, optionally in combination with poly (ethylene oxide-co-propylene oxide) copolymers or homopolymers.

It is still a further object of the invention to provide a liquid developer wherein developed image defects, such as smearing, loss of resolution and loss of density, are eliminated, or minimized, and wherein there are selected economical charge directors that permit toners that can be easily transferred from imaging members such as photoreceptor drums.

The present invention in embodiments relates to liquid developers with certain charge directors comprised of organic aluminum complexes and as charge additives cyclodextrins, reference the cyclodextrins of U.S. Pat. No. 5,627,002, the disclosure of which is totally incorporated herein by reference. In embodiments, the present invention is directed to positively charged liquid developers comprised of a nonpolar liquid, thermoplastic resin, pigment, a cyclodextrin charge control additive, and a charge director comprised of organic aluminum complexes, and which charge director is present in the liquid developer in an amount of from about 1 to about 1,000 milligrams of charge director per 1 gram of developer solids wherein the developer solids are comprised of thermoplastic resin, pigment, and charge additive. In embodiments, the present invention is directed to liquid developers comprised of a nonpolar liquid, thermoplastic toner resin, cyclodextrin charge additive, pigment, and a charge director of an aluminum hydroxide, such as the aluminum salts of alkylated salicylic acid like, for example, hydroxy bis(3,5-tertiary butyl salicylic) aluminate, and which salts can be represented by the following formulas as indicated herein wherein $R_1$ is selected from the group consisting of hydrogen and alkyl with, for example, 1 to about 25 carbon atoms; and n is zero, 1, 2, 3 or 4. Alkyl embodiments for $R_1$ include methyl, ethyl, propyl, or butyl, and preferably isopropyl, n-butyl, isobutyl, or tert-butyl. The aforementioned aluminum salts are illustrated in U.S. Pat. No. 5,366,840 mentioned herein, the disclosure of which is totally incorporated herein by reference.

Important embodiments of the present invention are directed to a positively charged liquid developer comprised of a nonpolar liquid, thermoplastic resin particles, a non polar liquid insoluble charge adjuvant, cyclodextrin charge additive, pigment, and a charge director comprised of a nonpolar liquid soluble organic aluminum complex, or mixtures thereof of the formulas as illustrated herein and in U.S. Pat. No. 5,336,840, and wherein $R_1$, for example, is selected from the group consisting of hydrogen and alkyl, and n represents a number.

Examples of specific aluminum charge directors selected for the developers of the present invention, and present in various effective amounts as indicated herein, and, for example, from about 0.1 to about 15, preferably from about 1 to about 4 weight percent, based on the weight, for example, of all the developer components, or from about 1 to about 1,000 milligrams of charge director per gram of developer solids of resin, pigment and charge control additive, include aluminum di-tertiary-butyl salicylate; hydroxy bis(3,5-tertiary butyl salicylic) aluminate; hydroxy bis(3,5-tertiary butyl salicylic) aluminate mono-, di-, tri- or tetrahydrates; hydroxy bis(salicylic) aluminate; hydroxy bis (monoalkyl salicylic) aluminate; hydroxy bis(dialkyl salicylic) aluminate; hydroxy bis(trialkyl salicylic) aluminate; hydroxy bis(tetraalkyl salicylic) aluminate; hydroxy bis(hydroxy naphthoic acid) aluminate; hydroxy bis (monoalkylated hydroxy naphthoic acid) aluminate; bis (dialkylated hydroxy naphthoic acid) aluminate wherein alkyl preferably contains 1 to about 6 carbon atoms; bis (trialkylated hydroxy naphthoic acid) aluminate wherein alkyl preferably contains 1 to about 6 carbon atoms; bis (tetraalkylated hydroxy naphthoic acid) aluminate wherein alkyl preferably contains 1 to about 6 carbon atoms; and the like.

The aforementioned charge director can be prepared as illustrated in U.S. Pat. No. 5,223,368 and U.S. Pat. No. 5,366,840, the disclosures of which are totally incorporated herein by reference, and more specifically, these additives can be obtained by the reaction of two equivalents of the sodium salt of, for example, 3,5-di-tert-butyl salicylic acid with one half equivalent of a dialuminum salt, for example aluminum sulfate, $Al_2(SO_4)_3$, in an aqueous alkali solution which generates a 2:1 complex of two salicylic acid molecules about a single central aluminum atom wherein both carboxylate groups of the salicylic acid moieties are covalently bonded through the carboxylate oxygen atom to the aluminum atom. It is also believed that the hydroxy aluminum complex compounds can have a hydroxyl group (—OH) that is covalently bonded to the aluminum atom (Al), that is an Al—OH. Also, the aromatic hydroxyl groups of the salicylic acid may be datively coordinated rather than covalently bonded to the central aluminum atom. The degree of hydration of the hydroxy aluminate complexes may vary as indicated by the subscript n and may be equal to 0, 1, 2, 3 or 4, and may depend upon how vigorously the complex is dried after isolation. It is further believed that the hydroxy aluminate complexes when formed with the processes as illustrated in U.S. Pat. No. 5,223,368 can in embodiments form mixtures with the mixture containing from 1 percent to 99 percent of each component. The water of hydration is believed to be strongly associated with the aluminum atom and is not easily removed upon heating under vacuum for 24 hours at 100° C. and above. Therefore, the aluminum charge directors of the present invention in embodiments can be prepared by the reaction of at least two molar equivalents of the sodium or alkali salt of a salicylic acid derivative wherein $R_1$ is hydrogen or alkyl with, for example, from 1 to about 25 carbon atoms, and wherein n represents the number of $R_1$ groups, and can be zero, 1, 2, 3 or 4 with a one molar aluminum equivalent of an aluminum containing salt, for example using a dialuminum salt, such as aluminum sulfate, $Al_2(SO_4)_3$, being about one half molar equivalent. The aluminum salt reactant may be a hydrated compound, for example $Al_2(SO_4)_3.xH_2O$, and wherein X represents the number of water components such as 0 to about 25. The reaction sequence is preferably accomplished by first converting an alpha hydroxy carboxylic acid compound, that is a salicylic acid derivative, for example, when converting the formed compounds into the corresponding alkali metal salt, for example sodium, in an aqueous alkali solution. The aqueous alkali solution containing the alkali salt of the alpha hydroxy carboxylate is then added to an acidic aqueous solution containing the aluminum containing salt reactant with rapid stirring. This inverse addition ensures that the complexing aluminum species is initially present in excess relative to the concentration of the added sodium salt. The inverse addition also avoids or minimizes tris- complex formation, $[RCO_2]_3Al$, wherein R is alkyl, that is a product having three carboxylate containing ligands bonded to the aluminum atom and no hydroxy-aluminum bond. Cooling the reaction mixture to room temperature generates a precipitate that may be collected by filtration. The crude product may be purified further by washing with, for example, water or other suitable solvents until the acidity of the wash water is nearly constant, for example a pH of about 5.5. The product is preferably dried to a constant weight in a vacuum drying oven. The reaction can provide a 2:1 complex of two salicylic acid molecules arranged about a single central aluminum atom wherein both carboxylate groups of the salicylic acid moieties are covalently bonded through the carboxylate oxygen atom to the aluminum atom. It is also believed that the hydroxy aluminum complex compounds prepared in this manner have a hydroxyl group (—OH) that is covalently bonded to the aluminum atom.

Embodiments of the present invention include a positively charged liquid developer comprised of thermoplastic resin particles, and the aluminum charge director illustrated herein; a liquid developer comprised of a liquid component, thermoplastic resin, pigment, charge control additive, such as a cyclodextrin and derivatives thereof, or a copolymer of poly(ethylene oxide-co-propylene oxide) or homopolymer of either, and the aluminum charge director illustrated herein; and a positively charged liquid electrostatographic developer comprised of (A) a nonpolar liquid having viscosity of from about 0.5 to about 20 centipoise, and a resistivity equal to or greater than about $5\times10^9$ with a maximum resistivity, for example, of $5\times10^{13}$ in embodiments; (B) thermoplastic resin particles with an average volume particle diameter of from about 0.1 to about 30 microns and pigment; (C) charge control additive and an optional charge adjuvant, and wherein the charge adjuvant is associated with or combined, preferably permanently, with the resin and pigment; and (D) as a charge director an organic aluminum complex as illustrated herein.

A positively charged liquid developer of the present invention is comprised of a nonpolar liquid component, thermoplastic resin, pigment, cyclodextrin charge control additive, reference copending application U.S. Ser. No. 690,881. Specific examples of cyclodextrins, many of which are available from American Maize Products Company, selected include the parent compounds, alpha cyclodextrin, beta cyclodextrin, and gamma cyclodextrin, branched alpha, beta and gamma cyclodextrins, and substituted alpha, beta and gamma cyclodextrin derivatives having varying degrees of substitution. Alpha, beta and gamma cyclodextrin derivatives include 2-hydroxyethyl cyclodextrin, 2-hydroxypropyl cyclodextrin, acetyl cyclodextrin, methyl cyclodextrin, ethyl cyclodextrin, succinyl beta cyclodextrin, nitrate ester of cyclodextrin, N,N-diethylamino-N-2-ethyl cyclodextrin, N,N-morpholino-N-2-ethyl cyclodextrin, N,N-thiodiethylene-N-2-ethyl-cyclodextrin, and N,N-diethyleneaminomethyl-N-2 ethyl cyclodextrin wherein the degree of substitution can vary from 1 to 18 for alpha cyclodextrin derivatives, 1 to 21 for beta cyclodextrin derivatives, and 1 to 24 for gamma cyclodextrin derivatives. The degree of substitution is the extent to which cyclodextrin hydroxyl hydrogen atoms were substituted by the indicated named substituents in the derivatized cyclodextrins. Mixed cyclodextrin derivatives, containing 2 to 5 different substituents, and from 1 to 99 percent of any one substituent may also be selected. Additional alpha, beta, and gamma cyclodextrin derivatives include those prepared by reacting monochlorotriazinyl-beta-cyclodextrin, available from Wacker-Chemie GmbH as beta W7 MCT and having a degree of substitution of about 2.8, with organic amines. Amine intermediates for reaction with the monochlorotriazinyl-beta-cyclodextrin derivative include molecules containing a primary or secondary aliphatic amine site and a second tertiary aliphatic amine site within the same molecule so that after nucleophilic displacement of the reactive chlorine in the monochlorotriazinyl-beta-cyclodextrin derivative has occurred, the resulting cyclodextrin triazine CCA product retains its free tertiary amine site (for proton capture and charging the toner positively) even though the primary or secondary amine site was consumed in covalent attachment to the triazine ring. In addition, said amine intermediates may be difunctional in primary and/or secondary aliphatic amine sites and mono or multi-functional in tertiary amine sites so that after nucleophilic displacement of the reactive chlorine in the monochlorotriazinyl-beta-cyclodextrin derivative has occurred, polymeric forms of the resulting cyclodextrin triazine CCA product result. Preferred amine intermediates selected to react with the monochlorotriazinyl-beta-cyclodextrin derivative to prepare tertiary amine bearing cyclodextrin derivatives include 4-(2-aminoethyl) morpholine, 4-(3-aminopropyl) morpholine, 1-(2-aminoethyl) piperidine, 1-(3-aminopropyl)-2-pipecoline, 1-(2-aminoethyl) pyrrolidine, 2-(2-aminoethyl)-1-methylpyrrolidine, 1-(2-aminoethyl) piperazine, 1-(3-aminopropyl) piperazine, 4-amino-1 -benzylpiperidine, 1-benzylpiperazine, 4-piperidinopiperidine, 2-dimethylaminoethyl amine, 1,4-bis(3-aminopropyl) piperazine, 1-(2-aminoethyl)piperazine, 4-(aminomethyl) piperidine, 4,4'-trimethylene dipiperidine, and 4,4'-ethylenedipiperidine. Mixed cyclodextrins derived from the monochlorotriazinyl-beta-cyclodextrin derivative may contain 2 to 5 different substituents, and from 1 to 99 percent of any one substituent.

Examples of liquid carriers, or nonpolar liquids selected for the developers of the present invention include a liquid with an effective viscosity as measured, for example, by a number of known methods, such as capillary viscometers, coaxial cylindrical rheometers, cone and plate rheometers, and the like of, for example, from about 0.5 to about 500 centipoise, and preferably from about 1 to about 20 centipoise, and a resistivity equal to or greater than $5\times10^9$ ohm/cm, such as $5\times10^{13}$. Preferably, the liquid selected is a branched chain aliphatic hydrocarbon as illustrated herein. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling point range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° as determined by the ASTM D-56 method. The liquids selected should have an electrical volume resistivity in excess of 109 ohm-centimeters and a dielectric constant below 3.0. Moreover, the vapor pressure at 25° C. should be less than 10 Torr in embodiments. The amount of liquid carrier or nonpolar liquid selected is from about 75 to about 99.9 weight percent and preferably between 95 and 99 weight percent.

Although in embodiments the ISOPAR® series liquids can be the preferred nonpolar liquids for use as dispersants in the liquid developers of the present invention, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developers of the present invention is as indicated herein, for example from about 75 percent to about 99.9 percent, and preferably from about 95 to about 99 percent by weight of the total developer solids dispersion. The total solids components content of the developer is, for example, from about 0.1 to about 25 percent by weight, and preferably from about 1.0 to about 5 percent.

Typical suitable thermoplastic toner resin can be selected for the liquid developers of the present invention in effective amounts of, for example, in the range of from about 99 percent to about 40 percent, and preferably about 95 percent to about 70 percent of developer solids comprised of thermoplastic resin, pigment, charge adjuvant, and in embodiments other optional components such as magnetic materials, like magnetites that may comprise the developer. Generally, developer solids include the thermoplastic resin, pigment and charge adjuvant. Examples of thermoplastic resins include ethylene vinyl acetate (EVA) copolymers, (ELVAX® resins, E.I. DuPont de Nemours and Company, Wilmington, Del.); copolymers of ethylene and an beta-↑-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an beta-β-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin. The preferred resin in embodiments is ethylene vinyl acetate (EVA) copolymers, (ELVAX® resins, E.I. DuPont de Nemours and Company, Wilmington, Del.).

The liquid developer of the present invention preferably contains a colorant dispersed in the resin particles. Colorants, such as pigments or dyes like black, cyan, magenta, yellow, red, blue, green, brown, and mixtures wherein any one colorant may comprise from 0.1 to 99.9 weight percent of the colorant mixture with a second colorant comprising the remaining percentage thereof, are preferably present to render the latent image visible.

The colorant may be present in the resin particles in an effective amount of, for example, from about 0.1 to about 60 percent, and preferably from about 30 to about 50 percent by weight based on the total weight of solids contained in the developer. The amount of colorant selected may vary depending on the use of the developer; for instance, if the toned image is to be used to form a chemical resist image no pigment is necessary. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK™, PV FAST BLUE™, and Paliotol Yellow D115, the pigments as illustrated in U.S. Pat. No. 5,223,368, the disclosure of which is totally incorporated herein by reference.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is important for image development and background cleaning.

To increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid and polyphosphoric acid, may be added. Negative charge adjuvants increase the negative charge of the toner particle, that is they can serve to decrease the positive charge, while the positive charge adjuvants increase the positive charge of the toner particles.

The liquid electrostatic developer of the present invention can be prepared by a variety of known processes, such as, for example, mixing in a nonpolar liquid with the thermoplastic resin, charge additive, and colorant in a manner that the resulting mixture contains, for example, from about 15 to about 50 percent by weight of solids; heating the mixture to a temperature of from about 70° C. to about 130° C. until a uniform dispersion is formed; adding an additional amount of nonpolar liquid sufficient to decrease the total solids concentration of the developer, for example from to about 10 to about 30 percent by weight; cooling the dispersion to about 10° C. to about 50° C.; adding the charge director to the dispersion; and diluting the dispersion to 1 percent to 5 percent solids.

In the initial mixture, the resin, colorant and charge additive may be added separately to an appropriate vessel which can vary in size from about 50 milliliters to about 1,000 liters, such as, for example, an attritor, heated ball mill, heated vibratory mill, such as a Sweco Mill (manufactured by Sweco Company, Los Angeles, Calif.) equipped with particulate media for dispersing and grinding, a Ross double planetary mixer (manufactured by Charles Ross and Son, Hauppauge, N.Y.), or a two roll heated mill, which requires no particulate media. Useful particulate media include materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of from about 0.04 to about 0.5 inch (approximately 1.0 to approximately 13 millimeters).

Sufficient nonpolar liquid is added to provide in embodiments a dispersion of from about 15 to about 50 percent solids. This mixture is then subjected to elevated temperatures during the initial mixing procedure to plasticize and soften the resin. The mixture is sufficiently heated to provide a uniform dispersion of all the solid materials of, for example, colorant, adjuvant and resin. However, the temperature at which this step is accomplished should not be so high as to degrade the nonpolar liquid or decompose the resin or colorant when present. Accordingly, the mixture in embodiments is heated to a temperature of from about 70° C. to about 130° C., and preferably from about 70° C. to about 75° C. The mixture may be ground in a heated ball mill or heated attritor at this temperature for about 15 minutes to about 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to about 10 to about 30 percent by weight. The dispersion is then cooled to about 10° C. to about 50° C., and preferably to about 20° C. to about 25° C., while mixing is continued until the resin admixture solidifies or hardens. Upon cooling, the resin admixture precipitates out of the dispersant liquid. Cooling is accomplished by methods such as the use of a cooling fluid like water, or glycols, such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. The aluminum charge director can then be added. Other processes of preparation and liquid developers thereof are generally illustrated in U.S. Pat. Nos. 4,760,009; 5,017,451; 4,923,778 and 4,783,389, the disclosures of which are totally incorporated herein by reference.

Embodiments of the invention will be illustrated in the following nonlimiting Examples, it being understood that these Examples are intended to be illustrative only and that the invention is not intended to be limited to the materials, conditions, process parameters, and the like recited herein. Print density was measured using a Macbeth RD918 Reflectance Densitometer.

EXAMPLE I

Synthesis of the Charge Director Hydroxy Bis(3,5-Tertiary Butyl Salicylic) Aluminate, or Alohas at Elevated Temperature To a solution of 12 grams (0.3 mole) NaOH in 500 milliliters of water were added 50 grams (0.2 mole) of di-tert-butyl salicylic acid. The resulting mixture was heated to 60° C. to dissolve the acid. A second solution was prepared by dissolving 33.37 grams (0.05 mole) of aluminum sulfate, $Al_2(SO_4)_3.18H_2O$ into 200 milliliters of water with heating to 60° C. The former solution containing the sodium salicylate salt was added rapidly and dropwise into the latter aluminum sulfate salt solution with stirring. When the addition was complete, the reaction mixture was stirred an additional 5 to 10 minutes at 60° C. and then cooled to room temperature, about 25° C. The mixture was then filtered and the collected solid hydroxy bis(3,5-tertiary butyl salicylic) aluminate monohydrate was washed with water until the acidity of the used wash water was about 5.5. The product was dried for 16 hours in a vacuum oven at 110° C. to afford 52 grams (0.096 mole, 96 percent theory) of a white powder of the above monohydrate, melting point of >300° C. When a sample, about 50 grams, of the hydroxy bis(3,5-tertiary butyl salicylic) aluminate monohydrate was analyzed for water of hydration by Karl-Fischer titration after drying for an additional 24 hours at 100° C. in a vacuum, the sample contained 2.1 percent weight of water. The theoretical value calculated for the monohydrate was 3.2 percent weight of water.

Infrared spectra of the above bis hydroxy bis(3,5-tertiary butyl salicylic) aluminate monohydrate product indicated the absence of peaks characteristic of the starting material di-tert-butyl salicylic acid, and indicated the presence of an Al—OH band characteristic at 3,660 $cm^{-1}$ and peaks characteristic of water of hydration.

NMR analysis for the hydroxy aluminate complex was obtained for carbon, hydrogen and aluminum nuclei and were all consistent with the above prepared hydroxymonohydrate.

Elemental Analysis Calculated for $C_{30}H_{41}O_7Al$: C,66.25; H,7.62; Al,5.52.

Calculated for $C_{30}H_{41}O_7Al.1H_2O$: C, 64.13; H, 7.74; Al, 4.81.

Found: C, 64.26; H, 8.11; Al, 4.67.

Synthesis of Hydroxy Bis(3,5-Tertiary Butyl Salicylic) Aluminate Hydrate at Room Temperature The above procedure of charge director Synthesis I, was repeated with the exception that the mixing of the two solutions and subsequent stirring was accomplished at room temperature, about 25° C. The product was isolated and dried as in Charge Director Synthesis I, and identified as the above hydroxy aluminum complex hydrate by IR.

A 3 percent solution (Sample 1A) of Alohas (obtained from the above elevated temperature synthesis procedure) in ISOPAR®G was prepared by dissolving 42.00 grams of Alohas powder in 1,358.01 grams of ISOPAR®G in a 0.5 gallon Nalgene high density polyethylene bottle. The contents of the bottle were agitated at ambient temperature for 4 hours on a 6000 Shaker Power Unit (reciprocating shaker available from Eberbach Corporation, Ann Arbor, Mich.) set at slow speed (60 to 165 excursions per minute) to hasten the dissolution process. This charge director solution was stored for at least 6 weeks at ambient conditions before using to charge the invention liquid toners described in this invention.

A 3 percent solution (Sample 1B) of Alohas (from the above elevated temperature synthesis procedure) in ISOPAR®M was prepared by dissolving 45.00 grams Alohas powder in 1455.00 grams of ISOPAR®M in a 0.5 gallon Nalgene high density polyethylene bottle. The contents of the bottle were warmed for 0.25 hour in a 50° C. water bath to hasten the dissolution process. This charge director solution was stored for at least 6 weeks at ambient conditions before using to charge the invention liquid toners.

A 3 percent solution (Sample 1C) of Alohas (from the above elevated synthesis procedure) in ISOPAR®G was prepared by dissolving 350.00 grams of Alohas powder in 11,320.40 grams of ISOPAR®G in a 5.0 gallon Nalgene high density polyethylene carboy. The contents of the carboy were briefly manually shaken and this charge director solution was stored for about 6 weeks at ambient conditions before using to charge the invention liquid toners.

EXAMPLE II

Formulations of the Control Charge Director Hydroxy Bis(3,5-Tertiary Butyl Salicylic) Aluminate and EMPHOS PS-900™ (1:1 by Weight):

A 3 percent solution (Sample 2A) of Alohas (from the elevated synthesis procedure in Example I) (1.5 percent) and EMPHOS-PS-900™ (1.5 percent) (Witco Chemical) was prepared at ambient temperature by combining, in a 1.0 liter Nalgene high density polyethylene bottle, 350.00 grams (10.5 grams solids) of the 3 weight percent Alohas-ISOPAR®G solution prepared in Example I (Sample 1A) with 52.5 grams (10.5 grams solids) of a 20 weight percent solution of EMPHOS PS-900™ in ISOPAR®G. The EMPHOS PS-900™ solution was prepared at ambient temperature by dissolving 80 grams of EMPHOS PS-900™ in 320 grams of ISOPAR®G in a 0.5 liter Nalgene polyethylene bottle. The 3 percent Alohas-EMPHOS PS-900™ solution in ISOPAR®G was agitated at ambient temperature for 4 hours on a 6000 Shaker Power Unit (reciprocating shaker available from Eberbach Corporation, Ann Arbor, Mich.) set at slow speed (60 to 165 excursions per minute) to hasten the dissolution process. This charge director solution was stored for at least 6 weeks, and more specifically, about 7 weeks at ambient conditions before using to charge the invention liquid toners.

Optionally (Method 2A), an appropriate quantity of the 20 percent EMPHOS PS-900™ in ISOPAR®G solution was added to a previously prepared liquid developer, charged with Alohas charge director alone, so that the weight of the added EMPHOS PS-900™ charge director component would equal the weight of the Alohas charge director component already present in the developer thereby doubling the total charge director level versus that when the Alohas charge director was present alone in the initially prepared liquid developer.

A 3 percent solution (Sample 2B) of Alohas (from the elevated temperature synthesis procedure in Example I) (1.5 percent) and EMPHOS PS-900™ (1.5 percent) (Witco Chemical) was prepared at ambient temperature by combining, in a 0.25 liter Nalgene high density polyethylene bottle, 58.82 grams (1.76 grams solids) of the 3 weight percent Alohas-ISOPAR®M solution prepared in Example I) (Sample 1B) with 8.82 grams (1.76 grams solids) of the 20 weight percent solution of the above EMPHOS PS-900™ in ISOPAR®G. This charge director solution was stored for 7 weeks at ambient conditions before using to charge the invention liquid toners.

A 3 percent solution (Sample 2C) of Alohas (from the elevated synthesis procedure in Example I) (1.5 percent) and EMPHOS PS-900™ (1.5 percent) (Witco Chemical) in ISOPAR®G was prepared at ambient temperature by adding 50 percent of the required weight (5,432 grams) of ISOPAR®G to 84.00 grams of Alohas powder in a 3 gallon Nalgene high density polyethylene carboy. Subsequently, 84.00 grams of EMPHOS PS-900™ were added to the carboy followed by the second 50 percent of the ISOPAR®G. The contents of the carboy were briefly manually shaken and this charge director solution was stored for about 6 weeks at ambient conditions before using to charge the invention liquid toners.

EXAMPLE III

Preparation of Black Liquid Toner Concentrate and Developers (Inks): [Inks 27535-37-4 and -5 and Toner Conc. 27535-31]

Black Liquid Toner Developers Containing 7 percent of Beta Cyclodextrin as Charge Control Agent (CCA):

Examples IIIA to IIIE and Controls 3A to 3E: (Sample 3A Toner Concentrate)—1.5 percent Toner Solids—40 percent REGAL 330® carbon black pigment—10/1, 15/1, 20/1, 25/1, and 30/1 Alohas CD versus 20/1, 30/1, 40/1, 50/1 and 60/1 Alohas:EMPHOS PS-900™CD.

One hundred and forty-three point one (143.1) grams of ELVAX 200W® (a copolymer of ethylene and vinyl acetate with a melt index at 190° C. of 2500, available from E.I. DuPont de Nemours and Company, Wilmington, Del.), 108.0 grams of the black pigment REGAL 330® (Cabot Corporation), 18.9 grams of beta-cyclodextrin (Cerestar USA, Inc. formerly American Maize-Products Company) and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm and while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 300 grams of ISOPAR®G to collect residual liquid toner concentrate adhering to the steel balls. This Example III liquid toner concentrate had a toner solids concentration of 14.374 weight percent and was used to formulate the black liquid developers (inks) described in Table 1.

All the black liquid developers prepared from Sample 3A black liquid toner concentrate in this Example contained 40 percent of REGAL 330® carbon black pigment and 7 percent beta-cyclodextrin charge control agent. The developers were formulated to give 1.5 weight percent toner solids [(292.19 grams) (0.14374)=42.00 grams toner solids in 2,800 grams total developer weight] wherein the toner solids include toner resin, pigment and charge control agent. The experimental developer initially contained 10/1 milligrams of Alohas charge director (CD) per gram of toner solids and was sequentially increased to 15/1, 20/1, 25/1, and 30/1 CD levels using the same charge director solution source. The control developer initially contained 20/1 milligrams of Alohas:EMPHOS PS-900™ charge director per gram of toner solids and was sequentially increased to 30/1, 40/1, 50/1, and 60/1 CD levels using the same CD solution source. The experimental charge director was Alohas, as prepared and formulated in Example I (Sample 1A), and the control charge director was Alohas:EMPHOS PS-900™ as formulated in Example II (Sample 2A).

The print tests at each CD level for both the experimental and control inks were performed on a Xerox Corporation ColorgrafX 8936 electrographic printer set at a contrast of 50 percent (which was equivalent to an input voltage in the range of about 120 to 125 volts) and a paper (Rexham 6262) or process speed of 2 ips. The toner formulations and the reflective optical density (ROD) print test results measured with a Macbeth RD918 Reflectance Densitometer and the total developer charge (Q) measured using the Series-Capacitor Technique are provided in Table 1. The developers in Table 1 were retained at ambient conditions for at least 2 days, and more specifically 3 days, prior to print test evaluation.

TABLE 1

Black Developer Formulations - Total Charge-Print Test Results

| Developer No. | Grams of Sample 3A Toner Concentrate | Grams of Added ISOPAR ® G Carrier Fluid | Total Grams of 3 percent CD Solution | CD Level in mg CD/g Toner Solids | Developer Charge (Q) | Reflective Optical Density (ROD) at 2 ips |
|---|---|---|---|---|---|---|
| Example IIIA | 292.19 | 2493.81 | 14.00 | 10/1 | 0.20 | 1.31 |
| Example IIIB | same | same | 21.00 | 15/1 | — | 1.35 |
| Example IIIC | same | same | 28.00 | 20/1 | 0.30 | 1.32 |
| Example IIID | same | same | 35.00 | 25/1 | — | 1.36 |
| Example IIIE | same | same | 42.00 | 30/1 | 0.30 | 1.34 |
| Control 3A | same | 2479.81 | 28.00 | 20/1 | 0.04 | 1.05 |
| Control 3B | same | same | 42.00 | 30/1 | — | 0.74 |
| Control 3C | same | same | 56.00 | 40/1 | 0.04 | 1.04 |
| Control 3D | same | same | 70.00 | 50/1 | — | 0.70 |
| Control 3E | same | same | 84.00 | 60/1 | — | 1.09 |

To 292.19 grams of the Example III liquid toner concentrate (14.374 percent solids) were added 2,493.81 grams of ISOPAR®G (Exxon Corporation) and 14.0 grams of Alohas charge director (Sample 1A) to provide a charge director level of 10 milligrams charge director per gram of toner solids (Example IIIA ink). To obtain developers (Examples IIIB to IIIE) with the next higher Alohas CD levels, as described in Table 1, 7.00 gram increments of the same 3 percent CD solution (Sample 1A) were added to the developer having the previously highest CD level.

To 292.19 grams of the Example III liquid toner concentrate (14.374 percent solids) were added 2,479.81 grams of ISOPAR®G (Exxon Corporation) and 28.00 grams of 1:1 Alohas:EMPHOS PS-900™ charge director (Sample 2A) to give a charge director level of 20 milligrams of charge director per gram of toner solids (Control 3A ink). To obtain developers (Control 3B to 3E) with the next higher Alohas:EMPHOS PS-900™ CD levels, as described in Table 1, 14.00 gram increments of the same 3 percent CD solution (Sample 2A) were added to the developer having the previously highest CD level.

The higher reflective optical densities in Table 1 (Examples IIIA to IIIE) obtained for black developers charged with Alohas charge director at the same level or at lower levels used to charge the black developers with 1:1 by weight Alohas:EMPHOS PS-900™ charge director (Control 3A to 3E indicate that the Alohas (alone) charge director is responsible for increased print densities since no other developer compositional variables or printing variables were changed. Also, a comparison of the total developer charge for the Example IIIC developer versus the Control 3A developer at the same 20/1 charge director level indicates that the Example IIIC developer contains 7.5× as much charge as does the Control 3A developer. This increase in developer charge results in the development of more toner per unit area and the observed increased reflective optical print densities (RODs).

EXAMPLE IV

Preparation of Yellow Liquid Toner Concentrate and Developers (Inks): [Inks 27535-45-4 and -5 and Toner Conc. 27535-40]

Yellow Liquid Toner Developers Containing 5 Percent Beta Cyclodextrin as Charge Control Agent (CCA):

Examples IVA to IVD and Controls 4A to 4D: (Sample 4A Toner Concentrate), 1.5 percent toner solids, 40 percent of Sunbrite PY 17 Yellow Pigment—5/1, 10/1, 15/1 and 20/1 Alohas CD versus 10/1, 20/1, 30/1 and 40/1 Alohas:EMPHOS PS-900™ CD.

One hundred and forty-eight point five (148.5) grams of ELVAX 200W® (a copolymer of ethylene and vinyl acetate with a melt index at 190° C. of 2500, available from E.I. DuPont de Nemours and Company, Wilmington, Del.), 108.0 grams of the yellow pigment Sunbrite PY 17 (Sun Chemical), 13.5 grams of beta-cyclodextrin (Cerestar USA, Inc. formerly American Maize-Products Company) and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISO PAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 300 grams ISOPAR®G to collect residual liquid toner concentrate adhering to the steel balls. This Example IV liquid toner concentrate had a toner solids concentration of 13.586 weight percent and was used to formulate the yellow liquid developers (inks) described in Table 2.

The yellow liquid developers prepared from Sample 4A yellow liquid toner concentrate in this Example contained 40 percent of Sunbrite PY 17 pigment and 5 weight percent of beta-cyclodextrin charge control agent. The developers were formulated to provide 1.5 weight percent toner solids [(309.14 grams) (0.13586)=42.00 grams toner solids in 2,800 grams total developer weight] wherein the toner solids included toner resin, pigment and charge control agent. The experimental developer initially contained 5/1 milligrams of Alohas charge director (CD) per gram of toner solids and was sequentially increased to 10/1, 15/1, and 20/1 CD levels using the same charge director solution source. The control developer initially contained 10/1 milligrams of Alohas:EMPHOS PS-900™ charge director per gram of toner solids and was increased to 20/1, 30/1, and 40/1 CD levels using the same CD solution source. The experimental charge director was Alohas, as prepared and formulated in Example I (Sample 1A), and the control charge director was Alohas:EMPHOS PS-900™ as formulated in Example II (Sample 2A).

The print tests at each CD level for both the experimental and control inks were performed on a Xerox Corporation ColorgrafX 8936 electrographic printer set at a contrast of 50 percent (which was equivalent to an input voltage in the range of about 120 to 125 volts) and a paper (Rexham 6262) or process speed of 1 or 2 ips. The toner formulations and the reflective optical density (ROD) print test results measured with a Macbeth RD918 Reflectance Densitometer and the total developer charge (Q) measured using the Series-Capacitor Technique are provided in Table 2. The developers in Table 2 were allowed to stand at ambient conditions for 3 days prior to print test evaluation.

Alohas:EMPHOS PS-900™ charge director (Sample 2A) to give a charge director level of 10 milligrams charge director per gram of toner solids (Control 4A ink). To obtain developers with the next higher Alohas:EMPHOS PS-900™ CD levels, as described in Table 2, 14.00 gram increments of the same 3 percent CD solution (Sample 2A) were added to the developer with the above previously highest CD level.

The higher reflective optical densities (at both 2 ips and 1 ips process speeds) in Table 1 (Examples IVB to IVE) obtained for yellow developers charged with Alohas charge director at the same level or at lower levels used to charge the yellow developers with 1:1 by weight Alohas:EMPHOS PS-900™ charge director (Controls 4B to 4E) indicate that the Alohas (alone) charge director is responsible for the increased print densities since no other developer compositional variables or printing variables were changed. Also, a comparison of the total developer charge for the Example IVD developer versus the Control 4B developer at the same 20/1 charge director level indicates that the Example IVD developer contains 1.8× as much charge as the Control 4B developer. This increase in developer charge results in the development of more toner per unit area and the observed increased reflective optical print densities (RODs).

The Example IVA yellow liquid developer providing an ROD of only 0.15 at 2 ips and 0.55 at 1 ips indicates that 5/1 Alohas charge director is at too low a level to permit an effective developer and allow high quality images. Similarly, the Control 4A yellow liquid developer giving an ROD of only 0.47 at 2 ips and 0.89 at 1 ips indicates that 10/1 Alohas:EMPHOS PS-900™ charge director is also at too low a level to provide an effective developer and high quality images.

TABLE 2

Yellow Developer Formulations - Total Charge-Print Test Results

| Developer No. | Grams of Sample 4A Toner Concentrate | Grams of Added ISOPAR ® G Carrier Fluid | Total Grams of 3 percent CD Solution | CD Level in mg CD/g Toner Solids | Developer Charge (Q) | Reflective Optical Density (ROD) at 1 ips | Reflective Optical Density (ROD) at 2 ips |
|---|---|---|---|---|---|---|---|
| Example IVA | 309.14 | 2483.86 | 7.00 | 5/1 | — | 0.55 | 0.15 |
| Example IVB | same | same | 14.00 | 10/1 | 0.30 | 1.33 | 1.28 |
| Example IVC | same | same | 21.00 | 15/1 | — | 1.32 | 1.27 |
| Example IVD | same | same | 28.00 | 20/1 | 0.18 | 1.34 | 1.18 |
| Control 4A | same | 2476.86 | 14.00 | 10/1 | — | 0.89 | 0.47 |
| Control 4B | same | same | 28.00 | 20/1 | 0.10 | 1.21 | 0.93 |
| Control 4C | same | same | 42.00 | 30/1 | — | 1.22 | 0.94 |
| Control 4D | same | same | 56.00 | 40/1 | 0.10 | 1.20 | 0.90 |

To 309.14 grams of the Example IV liquid toner concentrate (13.586 percent solids) were added 2,483.86 grams of ISOPAR®G (Exxon Corporation) and 7.0 grams of Alohas charge director (Sample 1A) to provide a charge director level of 5 milligrams charge director per gram of toner solids (Example IVA ink). To obtain developers (Example IVB to IVD) with the next higher Alohas CD levels, as described in Table 2, 7.00 gram increments of the same 3 percent CD solution (Sample 1A) were added to the developer with the above previously highest CD level.

To 292.19 grams of the Example IV liquid toner concentrate (13.586 percent solids) were added 2,476.86 grams of ISOPAR®G (Exxon Corporation) and 14.00 grams of 1:1

EXAMPLE VA

Preparation of Cyan Liquid Toner Concentrate and Developers (Inks): [Inks 27520-47-2 and Toner Conc. 27520-42]

Cyan Liquid Toner Developers Containing 5 percent of N,N-Diethylamino-N-2-Ethyl Substituted Beta-Cyclodextrin as Charge Control Agent (CCA):

Examples VA-1, VA-2 and Control 5A-1: (Sample 5A Toner Concentrate), 1.5 percent toner solid, 30 percent Sunfast Blue 15:3 Pigment—2.5/1 and 5/1 Alohas CD versus 10/1 Alohas:EMPHOS PS-900™ CD.

Sample 5A

One hundred and seventy-five point five (175.5) grams of ELVAX 200W® (a copolymer of ethylene and vinyl acetate with a melt index at 190° C. of 2500, available from E.I. DuPont de Nemours and Company, Wilmington, Del.), 81.0 grams of the cyan pigment Sunfast Blue 15:3 (Sun Chemical), 13.5 grams of N,N-diethylamino-N-2-ethyl substituted beta-cyclodextrin (Cerestar USA, Inc. formerly American Maize-Products Company) and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 250 grams ISOPAR®G to collect residual liquid toner concentrate adhering to the steel balls. This Example VA liquid toner concentrate had a toner solids concentration of 15.826 weight percent and was used to formulate the cyan liquid developers (inks) described in Table 3.

The cyan liquid developers prepared in this Example from Sample 5A cyan liquid toner concentrate contained 30 percent of Sunfast Blue 15:3 pigment and 5 percent of N,N-diethylamino-N-2-ethyl substituted beta-cyclodextrin charge control agent. The developers were formulated to give 1.5 weight percent of toner solids [(265.39 grams) (0.15826)=42.00 grams toner solids in 2,800 grams total developer weight] wherein the toner solids include toner resin, pigment and charge control agent. This experimental developer initially contained 2.5/1 Alohas charge director (CD) per gram of toner solids, and was subsequently increased to the 5/1 CD level using the same charge director solution source. The control developer contained 10/1 Alohas:EMPHOS PS-900™ CD per gram of toner solids and was not subsequently increased. The experimental charge director was Alohas, as prepared and formulated in Example I (Sample 1B), and the control charge director was Alohas:EMPHOS PS-900™ (Method 2A from Example II). The control developer was formulated by adding to the experimental developer already containing 5/1 Alohas, a quantity of EMPHOS PS-900™ (from the 20 weight percent sample described in Example II) equivalent to 5/1 milligrams per gram of toner solids so that the final Alohas: EMPHOS PS-900™ charge director level in this control developer was 10/1 milligrams per gram of toner solids (5/1 of each component).

The print tests at each CD level for both the experimental and control inks were performed on a Xerox ColorgrafX 8936 electrographic printer set at a contrast of 50 percent (which was equivalent to an input voltage in the range of about 120 to 125 volts) and a paper (Rexham 6262) or process speed of 1 or 2 ips. The toner formulations as well as the reflective optical density (ROD) print test results measured with a Macbeth RD918 Reflectance Densitometer are provided in Table 3. The developers in Table 3 were allowed to stand at ambient conditions for at least 1 day prior to print test evaluations.

TABLE 3

Cyan Developer Formulations and Print Test Results

| Developer No. | Grams of Sample 5A Toner Concentrate | Grams of Added ISOPAR ® G Carrier Fluid | Total Grams of CD Solution(s) | CD Level in mg CD/g Toner Solids | Reflective Optical Density (ROD) at 1 ips | Reflective Optical Density (ROD) at 2 ips |
|---|---|---|---|---|---|---|
| Example VA-1 | 265.39 | 2531.11 | 3.50 of 3 percent Alohas Soln | 2.5/1 | 1.28 after 1 day of ink charging | 1.04 after 1 day of ink charging |
| Example VA-2 | same | same | 7.00 of 3 percent Alohas Soln | 5/1 | 1.30 after 4 + 2 days of ink charging | 1.05 after 4 + 2 days of ink charging |
| Control 5A-1 | same | same | 7.00 of 3 percent Alohas Soln. already in Example 5A-2 + 1.05 g of 20 percent Emphos PS-900 Soln. | 10/1 | 1.15 after 4 + 2 + 2 days of ink charging; last 2 days with added Emphos PS-900 | 1.08 after 4 + 2 + 2 days of ink charging; last 2 days with added Emphos PS-900 |

To 265.39 grams of the Example VA liquid toner concentrate (15.826 percent solids) were added 2,531.11 grams of ISOPAR®G (Exxon Corporation) and 3.50 grams of Alohas charge director (Sample 1B) to give a charge director level of 2.5 milligrams per gram of toner solids (Example VA-1 ink). To obtain the developer (Example VA-2) with the 5/1 milligrams Alohas CD per gram of toner solids, as described in Table 3, an additional 3.50 grams of the same 3 percent CD solution (Sample 1B) were added to the developer (Example VA-1 ink) already containing 2.5/1 milligram Alohas CD per gram of toner solids.

To obtain the control developer (Control 5A-1) described in Table 3, 1.05 grams (0.21 gram of EMPHOS PS-900™ solids) of a 20 weight percent solution of EMPHOS PS-900™ in ISOPAR®G was added to the 6 day old experimental developer (Example VA-2) already containing 7.00 grams (0.21 grams Alohas solids) of a 3 weight percent solution of Alohas in ISOPAR®M (from Sample 1B). The 6 day old experimental developer (Example VA-2) contained Alohas at the 2.5/1 milligram Alohas per gram toner solids level for 4 days and contained the bump-up CD level of 5/1 milligram Alohas per gram toner solids for an additional 2 days before the EMPHOS PS-900™ was added to create the Control 5A-1 developer which was print tested after another 2 days of charging.

The higher reflective optical densities in Table 3 obtained for the two experimental cyan developers (Examples VA-1 and VA-2 at 2.5/1 and 5/1 CD) charged with the Alohas charge director at a lower level than was used to charge the cyan control developer with 1:1 by weight Alohas:EMPHOS PS-900™ charge director (Control 5A-1 at 10/1) indicates that at a process speed of 1 inch per second (ips) the Alohas (alone) charge director is responsible for the increased print densities since no other developer compositional variables or printing variables were changed. At a paper speed of 2 ips, the reflective optical densities are about the same for both the experimental and control cyan developers wherein the control cyan developer (Control 5A-1 at 10/1) was charged with twice as much charge director versus the highest charged experimental developer (Example VA-2). The higher level of charge director in the control cyan developer (Control 5A-1) offered no print density advantage over the lower level of charge director in the experimental cyan developer (Example VA-2) indicating that about the same print density quality was obtainable with a lower level of the Alohas alone charge director than was obtainable with the higher level of the combination Alohas:EMPHOS PS-900™ (1:1 by weight) charge director.

EXAMPLE VB

Preparation of Cyan Liquid Toner Concentrate and Developers (Inks): [Iinks 27520-47-3 and Toner Conc. 27520-43]

Cyan Liquid Toner Developers Containing 5 Percent of N,N,N-Trimethyl-N-2-Hydroxypropyl Ammonium Chloride Substituted Beta-Cyclodextrin as Charge Control Agent (CCA):

Examples VB-1 and -2 and Control 5B-1: (Sample 5B Toner Concentrate), 1.5 percent of Toner Solids, 30 percent of Sunfast Blue 15:3 Pigment-2.5/1 and 5/1 Alohas CD versus 10/1 Alohas:EMPHOS PS-900™ CD.

Sample 5B

One hundred and seventy-five point five (175.5) grams of ELVAX 200W® (a copolymer of ethylene and vinyl acetate with a melt index at 190° C. of 2500, available from E.I. DuPont de Nemours and Company, Wilmington, Del.), 81.0 grams of the cyan pigment Sunfast Blue 15:3 (Sun Chemical), 13.5 grams of N,N,N-trimethyl-N-2-hydroxypropyl ammonium chloride substituted beta-cyclodextrin (Cerestar USA, Inc. formerly American Maize-Products Company) and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 250 grams ISOPAR®G to collect residual liquid toner concentrate adhering to the steel balls. This Example VB liquid toner concentrate had a toner solids concentration of 15.647 weight percent and was used to formulate the cyan liquid developers (inks) described in Table 4.

The cyan liquid developers prepared in this Example from Sample 5B cyan liquid toner concentrate contained 30 percent of Sunfast Blue 15:3 pigment and 5 percent of N,N,N-trimethyl-N-2-hydroxypropyl ammonium chloride substituted beta-cyclodextrin charge control agent. The developers were formulated to give 1.5 weight percent toner solids [(268.42 grams) (0.15647)=42.00 grams toner solids in 2,800 grams total developer weight] wherein the toner solids include toner resin, pigment and charge control agent. The experimental developer initially contained 2.5/1 Alohas charge director (CD) per gram of toner solids, and was subsequently increased to the 5/1 CD level using the same charge director solution source. The control developer contained 10/1 Alohas:EMPHOS PS-900™ CD per gram of toner solids and was not subsequently increased. The experimental charge director was Alohas, as prepared and formulated in Example I (Sample 1B), and the control charge director was Alohas:EMPHOS PS-900™ (Method 2A from Example II). The control developer was formulated by adding to the experimental developer already containing 5/1 Alohas a quantity of EMPHOS PS-900™ (from the 20 weight percent sample described in Example II) equivalent to 5/1 milligrams per gram of toner solids so that the final Alohas:EMPHOS PS-900™ charge director level in this control developer was 10/1 milligrams per gram of toner solids.

The print tests at each CD level for both the experimental and control inks were performed on a Xerox Corporation ColorgrafX 8936 electrographic printer set at a contrast of 50 percent (which was equivalent to an input voltage in the range of about 120 to 125 volts) and a paper (Rexham 6262) or process speed of 1 or 2 ips. The toner formulations as well as the reflective optical density (ROD) print test results measured with a Macbeth RD918 Reflectance Densitometer are provided in Table 4. The developers in Table 4 were allowed to stand at ambient conditions for 3 days prior to print test evaluation.

TABLE 4

Cyan Developer Formulations and Print Test Results

| Developer No. | Grams of Sample 5B Toner Concentrate | Grams of Added ISOPAR ® G Carrier Fluid | Total Grams of CD Solution(s) | CD Level in mg CD/g Toner Solids | Reflective Optical Density (ROD) at 1 ips | Reflective Optical Density (ROD) at 2 ips |
|---|---|---|---|---|---|---|
| Example VB-1 | 268.42 | 2528.08 | 3.50 of 3 Percent Alohas Soln | 2.5/1 | 1.28 after 4 day of charging | — |
| Example VB-2 | same | same | 7.00 of 3 Percent Alohas Soln | 5/1 | 1.18 after 4 + 2 days of charging | 1.10 after 4 + 2 days of charging |
| Control 5B-1 | same | same | 7.00 of 3 Percent Alohas Soln. already in Example 5B-2 + 1.05 g of 20 percent Emphos PS-900 Soln. | 10/1 | 1.16 after 4 + 2 + 2 days charging: last 2 days with added Emphos PS-900 | 1.04 after 4 + 2 + 2 days charging: last 2 days with added Emphos PS-900 |

To 268.42 grams of the Example VB liquid toner concentrate (15.647 percent solids) were added 2,528.08 grams of ISOPAR®G (Exxon Corporation) and 3.50 grams of Alohas charge director (Sample 1B) to give a charge director level of 2.5 milligrams per gram of toner solids (Example VB-1 ink). To obtain the developer (Example VB-2) with the 5/1 milligrams of Alohas CD per gram of toner solids, as described in Table 4, an additional 3.50 grams of the same 3 percent CD solution (Sample 1B) were added to the developer (Example VB-1 ink) already containing 2.5/1 milligrams of Alohas CD per gram of toner solids.

To obtain the control developer (Control 5B-1) described in Table 4, 1.05 grams (0.21 gram of EMPHOS PS-900™ solids) of a 20 weight percent solution of EMPHOS PS-900™ in ISOPAR®G were added to the 6 day old experimental developer (Example VB-2) already containing 7.00 grams (0.21 gram Alohas solids) of a 3 weight percent solution of Alohas in ISOPAR®M (from Sample 1B). The 6 day old experimental developer (Example VB-2) contained Alohas at the 2.5/1 milligrams Alohas per gram toner solids level for 4 days and contained the increased CD (charge director) level of 5/1 milligram Alohas per gram toner solids for an additional 2 days before the EMPHOS PS-900™ was added to create the Control 5B-1 developer which was print tested after another 2 days of charging.

The higher reflective optical densities in Table 4 obtained for the two experimental cyan developers (Examples VB-1 and VB-2 at 2.5/1 and 5/1) charged with the Alohas charge director at a lower level than was used to charge the cyan control developer with 1:1 by weight of Alohas:EMPHOS PS-900™ charge director (Control 5B-1 at 10/1) indicates that at a process speed of 1 inch per second (ips) the Alohas (alone) charge director is responsible for the increased print densities since no other developer compositional variables or printing variables were changed. At a paper speed of 2 ips, the optical density for the experimental cyan developer (Example VB-2) was still significantly higher than that for the control cyan developer (Control 5B-1) wherein the control cyan developer was charged with twice as much charge director versus the experimental cyan developer. The higher level of charge director in the control cyan developer did not increase print density versus the lower level of charge director in the experimental cyan developer.

EXAMPLE VI

Preparation of Cyan Liquid Toner Concentrate and Developers (Inks): [Inks 27535-47-1 and -2 and Toner Conc. 27535-40]

Cyan Liquid Toner Developers Containing 5 Percent of Pluronic F-108 as Charge Control Agent (CCA):

Examples VIA to VIC and Controls 6A to 6D: (Sample 6A Toner Concentrate)—1.5 of percent Toner Solids—40 of percent PV Fast Blue Pigment—10/1, 15/1 and 20/1 Alohas CD versus 10/1, 20/1, 30/1 and 40/1 Alohas:EMPHOS PS-900™ CD One hundred and forty-eight point five (148.5) grams of ELVAX 200W® (a copolymer of ethylene and vinyl acetate with a melt index at 190° C. of 2,500, available from E.I. DuPont de Nemours and Company, Wilmington, Del.), 108.0 grams of the cyan pigment PV FAST BLUE™ (Hoechst-Celanese), 13.5 grams of Pluronic F-108 [a tri-block copolymer of poly (ethylene oxide-co-propylene oxide-co-ethylene oxide) PEO-PPO-PEO of weight average molecular weight 14,600 wherein the block weight percent composition is about 35-30-35 available from BASF] and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 250 grams of ISOPAR®G to collect residual liquid toner concentrate adhering to the steel balls. This Example VIA liquid toner concentrate had a toner solids concentration of 14.344 weight percent and was used to formulate the cyan liquid developers (inks) described in Table 4.

The cyan liquid developers prepared in this Example from Sample 6A cyan liquid toner concentrate contained 40 percent of PV FAST BLUE™ pigment and 5 percent of Pluronic F-108 charge control agent. The developers were formulated to give 1.5 weight percent toner solids [(292.81 grams) (0.14344)=42.00 grams toner solids in 2,800 grams total developer weight] wherein the toner solids include toner resin, pigment and charge control agent. The experimental developer initially contained 10/1 Alohas charge director (CD) per gram of toner solids and was sequentially bumped up to the 15/1 and 20/1 Alohas CD levels using the same charge director solution source. The control developer contained 10/1 Alohas:EMPHOS PS-900™ CD per gram of toner solids and was sequentially increased to the 20/1, 30/1, and 40/1 Alohas:EMPHOS PS-900™ CD levels using the same charge director solution source. The experimental charge director was Alohas, as prepared and formulated in Example I: (Sample 1A), and the control charge director was Alohas:EMPHOS PS-900™ (Sample 2A).

The print tests at each CD level for both the experimental and control inks were performed on a Xerox Corporation ColorgrafX 8936 electrographic printer set at a contrast of 50 percent (which is equivalent to an input voltage in the range of about 120 to 125 volts) and a paper (Rexham 6262) or process speed of 1 or 2 ips. The toner formulations the reflective optical density (ROD) print test results measured with a Macbeth RD918 Reflectance Densitometer are provided in Table 5. The developers in Table 5 were allowed to stand at ambient conditions for 3 days prior to print test evaluation.

TABLE 5

Cyan Developer Formulations- Print Test Results

| Developer No. | Grams of Sample 6A Toner Concentrate | Grams of Added ISOPAR ® G Carrier Fluid | Total Grams of 3 percent CD Solution | CD Level in mg CD/g Toner Solids | Reflective Optical Density (ROD) at 1 ips | Reflective Optical Density (ROD) at 2 ips |
|---|---|---|---|---|---|---|
| Example VIA | 292.81 | 2493.19 | 14.00 | 10/1 | 1.24 | 1.21 |
| Example VIB | same | same | 21.00 | 15/1 | 1.16 | 1.19 |
| Example VIC | same | same | 28.00 | 20/1 | 1.18 | 1.17 |
| Control 6A | same | same | 14.00 | 10/1 | 1.12 | 1.12 |
| Control 6B | same | same | 28.00 | 20/1 | 1.09 | 1.01 |
| Control 6C | same | same | 42.00 | 30/1 | 0.98 | 0.95 |
| Control 6D | same | same | 56.00 | 40/1 | 1.01 | 0.98 |

To 292.81 grams of the Example VI (Sample 6A) liquid toner concentrate (14.344 percent solids) were added 2,493.19 grams of ISOPAR®G (Exxon Corporation) and 14.00 grams of Alohas charge director (Sample 1A) to give a charge director level of 10 milligrams charge director per gram of toner solids (Example VIA ink). To obtain developers (Example VIB and VIC) with the next higher Alohas CD levels, as described in Table 5, 7.00 gram increments of the same 3 percent CD solution (Sample 1A) were added to the developer having the previously highest CD level.

To 292.81 grams of the Example VI (Sample 6A) liquid toner concentrate (14.344 percent solids) were added 2,493.19 grams of ISOPAR®G (Exxon Corporation) and 14.00 grams of 1:1 Alohas:EMPHOS PS-900™ charge director (Sample 2A) to give a charge director level of 10 milligrams charge director per gram of toner solids (Control 6A ink). To obtain developers (Controls 6B to 6D) with the next higher Alohas:EMPHOS PS-900™ CD levels, as described in Table 5, 14.00 gram increments of the same 3 percent CD solution (Sample 2A) were added to the developer having the previously highest CD level.

The higher reflective optical densities in Table 5 (Examples VIA to VIC) at both process speed of 1 and 2 ips obtained for cyan developers charged with Alohas charge director at the same level or at lower levels used to charge the cyan developers with 1:1 by weight Alohas:EMPHOS PS-900™ charge director (Controls 6A to 6D) clearly indicate that the Alohas (alone) charge director is responsible for the increased print densities since no other developer compositional variables or printing variables were changed.

EXAMPLE VII

Preparation of Cyan Liquid Toner Concentrates and Developers (Inks)

Cyan Liquid Toner Developers Containing No CCA:

Example VIIA: (Sample 7A toner concentrate), 1.5 percent of toner solids, 35 percent of PV FAST BLUE™ pigment, 2.5/1, 5/1, and 10/1 Alohas CD versus 5/1, 10/1 and 20/1 Alohas:EMPHOS PS-900™ CD Example VIIB: (Sample 7B toner concentrate), 1.5 percent of toner solids, 40 percent of PV FAST BLUE™ pigment, 2.5/1, 5/1 and 10/1 Alohas CD versus 5/1, 10/1 and 20/1 Alohas:EMPHOS PS-900™ CD Example VIIC: (Sample 7C toner concentrate), 4.0 percent of toner solids, 50 percent of PV FAST BLUE™ pigment, 20/1 Alohas CD versus (Sample 7D toner concentrate), 4.0 percent of toner solids, 50 percent of PV FAST BLUE™ Pigment, 50/1 Alohas CD Level Sample 7A for Examples VIIA-1 to 3 and for Controls 7A-1 to 3: cyan liquid toner concentrate containing 35 percent of PV FAST BLUE™ and no CCA.

[Sample 7A: Inks 27535-12-1 and -2 and Toner Conc. 27535-1]

One hundred and seventy-five point five (175.5) grams of ELVAX 200W® (a copolymer of ethylene and vinyl acetate with a melt index at 190° C. of 2500, available from E.I. DuPont de Nemours and Company, Wilmington, Del.), 94.5 grams of the cyan pigment PV FAST BLUE™ (Hoechst-Celanese), and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate and further rinsing the steel balls with about 300 grams of ISOPAR®G to collect residual liquid toner concentrate adhering to the steel balls. This Example VIIA liquid toner concentrate had a toner solids concentration of 15.345 weight percent and was used to formulate the cyan liquid developers (inks) described in Table 6.

The cyan liquid developers prepared in this Example from Sample 7A cyan liquid toner concentrate contained 35 percent of PV FAST BLUE™ pigment and no charge control agent. The developers were formulated to give 1.5 weight percent toner solids [(273.70 grams) (0.15345)=42.00 grams toner solids in 2,800 grams total developer weight] wherein the toner solids include toner resin and pigment. The experimental developer initially contained 2.5/1 Alohas charge director (CD) per gram of toner solids, and was sequentially increased or bumped up to the 5/1 and 10/1 Alohas CD levels using the same charge director solution source. The control developer contained 5/1 Alohas:EMPHOS PS-900™ CD per gram of toner solids, and was sequentially bumped up to the 10/1 and 20/1 Alohas:EMPHOS PS-900™ CD levels using the same charge director solution source. The experimental charge director was Alohas, as prepared and formulated in Example I (Sample 1B), and the control charge director was Alohas:EMPHOS PS-900™ (Sample 2B).

The print tests at each CD level for both the experimental and control inks were performed on a Xerox ColorgrafX 8936 electrographic printer set at a contrast of 50 percent (which was equivalent to an input voltage in the range of about 120 to 125 volts) and a paper (Rexham 6262) or process speed of 1 or 2 ips. The toner formulations as well as the reflective optical density (ROD) print test results measured with a Macbeth RD918 Reflectance Densitometer are provided in Table 6. The developers in Table 6 were allowed to stand at ambient conditions for about 3 days prior to print test evaluation.

TABLE 6

Cyan Developer Formulations- Print Test Results

| Developer No. | Grams of Sample 7A Toner Concentrate | Example VIIA-1 | Total Grams of 3 percent CD Solution | CD Level in mg CD/g Toner Solids | Reflective Optical Density (ROD) at 1 ips | Reflective Optical Density (ROD) at 2 ips |
|---|---|---|---|---|---|---|
| | 273.70 | 2522.80 | 3.50 | 2.5/1 | 1.28 | 1.23 |
| Example VIIA-2 | same | same | 7.00 | 5/1 | 1.24 | 1.19 |
| Example VIIA-3 | same | same | 14.00 | 10/1 | 1.09 | 1.18 |
| Control 7A-1 | same | 2519.30 | 7.00 | 5/1 | 1.32 | 1.21 |
| Control 7A-2 | same | same | 14.00 | 10/1 | 1.29 | 1.20 |
| Control 7A-3 | same | same | 28.00 | 20/1 | 1.22 | 1.18 |

To 273.70 grams of the Example VIIA (Sample 7A) liquid toner concentrate (15.345 percent solids) were added 2,522.80 grams of ISOPAR®G (Exxon Corporation) and 3.50 grams of Alohas charge director (Sample 1B) to give a charge director level of 2.5 milligrams charge director per gram of toner solids (Example VIIA-1 ink). To obtain developers (Example VIIA-2 and VIIA-3) with the next higher Alohas CD levels, as described in Table 6, 3.50 grams and then 7.00 grams of the same 3 percent CD solution (Sample 1B) were added to the developer having the previously highest CD level.

To 273.70 grams of the Example VIIA (Sample 7A) liquid toner concentrate (15.345 percent solids) were added 2,519.30 grams of ISOPAR®G (Exxon Corporation) and 7.00 grams of 1:1 Alohas:EMPHOS PS-900™ charge director (Sample 2B) to give a charge director level of 5 milligrams charge director per gram of toner solids (Control 7A-1 ink). To obtain developers (Controls 7A-2 and 7A-3) with the next higher Alohas:EMPHOS PS-900™ CD levels, as described in Table 6, 7.00 grams and then 14.00 grams of the same 3 percent CD solution (Sample 2B) were added to the developer having the previously highest CD level.

The reflective optical densities, at the higher 2 ips process (paper) speed described in Table 6, are not significantly larger or smaller (margin of measurement error +or −0.02) for the Alohas charged inks (Examples VIIA to VIIC) versus the Alohas:EMPHOS PS-900™ charged inks (Controls 7A to 7C) indicating no significant ROD improvement assignable to the Alohas charge director. However, at the slower 1 ips process speed, the reflective optical densities for the control developers containing Alohas:EMPHOS PS-900™ as the charge director afford higher reflective optical densities than do the experimental developers containing Alohas only as the charge director. In the absence of CCA charging sites and at this low (35 percent) pigment level, there are insufficient cyan pigment surface sites on the toner particles to enable beneficial charging by the Alohas charge director. The absence of an ROD improvement assignable to the Alohas charge director indicates the importance of the toner charging interaction between the Alohas charge director and the charge control agents when both are present.

Sample 7B for Examples VIIB-1 to 3 and for Controls 7B-1 to 3: Cyan Liquid Toner Concentrate Containing 40 Percent of PV FAST BLUE™ and No CCA

[Sample 7B: Inks 27535-18-2 and -3 and Toner Conc. 27535-2]

One hundred and sixty-two (162.0) grams of ELVAX 200W® (a copolymer of ethylene and vinyl acetate with a melt index at 190° C. of 2500, available from E.I. DuPont de Nemours and Company, Wilmington, Del.), 108.0 grams of the cyan pigment PV FAST BLUE™ (Hoechst-Celanese), and 405 grams of ISOPAR®M (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate, and further rinsing the steel balls with about 300 grams ISOPAR®G to collect residual liquid toner concentrate adhering to the steel balls. This Example VIIB liquid toner concentrate had a toner solids concentration of 14.308 weight percent and was used to formulate the cyan liquid developers (inks) described in Table 7.

The cyan liquid developers prepared in this Example from Sample 7B cyan liquid toner concentrate contained 40 percent of PV FAST BLUE™ pigment and no charge control agent. The developers were formulated to give 1.5 weight percent of toner solids [(293.54 grams) (0.14308)=42.00 grams toner solids in 2,800 grams total developer weight] wherein the toner solids include toner resin and pigment. The experimental developer initially contained 2.5/1 Alohas charge director (CD) per gram of toner solids and was sequentially bumped up to the 5/1 and 10/1 Alohas CD levels using the same charge director solution source. The control developer contained 5/1 Alohas:EMPHOS PS-900™ CD per gram of toner solids, and was sequentially bumped up to the 10/1 and 20/1 Alohas:EMPHOS PS-900™ CD levels using the same charge director solution source. The experimental charge director was Alohas, as prepared and formulated in Example I (Sample 1A), and the control charge director was Alohas:EMPHOS PS-900™ (Sample 2A).

The print tests at each CD level for both the experimental and control inks were performed on a Xerox ColorgrafX 8936 electrographic printer set at a contrast of 50 percent (which was equivalent to an input voltage in the range of about 120 to 125 volts) and a paper (Rexham 6262) or process speed of 1 or 2 ips. The toner formulations as well as the reflective optical density (ROD) print test results measured with a Macbeth RD918 Reflectance Densitometer are provided in Table 7. The developers in Table 7 were allowed to stand at ambient conditions for at least 2 days prior to print test evaluation.

TABLE 7

Cyan Developer Formulations - Print Test Results

| Developer No. | Grams of Sample 7B Toner Concentrate | Grams of Added ISOPAR ® G Carrier Fluid | Total Grams of 3 percent CD Solution | CD Level in mg CD/g Toner Solids | Reflective Optical Density (ROD) at 1 ips | Reflective Optical Density (ROD) at 2 ips |
|---|---|---|---|---|---|---|
| Example VIIB-1 | 293.54 | 2502.96 | 3.50 | 2.5/1 | 1.31 | 1.29 |
| Example VIIB-2 | same | same | 7.00 | 5/1 | 1.27 | 1.24 |
| Example VIIB-3 | same | same | 14.00 | 10/1 | 1.15 | 1.12 |
| Control 7B-1 | same | 2499.46 | 7.00 | 5/1 | 1.31 | 1.27 |
| Control 7B-2 | same | same | 14.00 | 10/1 | 1.30 | 1.30 |
| Control 7B-3 | same | same | 28.00 | 20/1 | 1.28 | 1.25 |

To 293.54 grams of the Example VIIB (Sample 7B) liquid toner concentrate (14.308 percent solids) were added 2,502.96 grams of ISOPAR®G (Exxon Corporation) and 3.50 grams of Alohas charge director (Sample 1A) to give a charge director level of 2.5 milligrams of charge director per gram of toner solids (Example VIIB-1 ink). To obtain developers (Example VIIB-2 and 7B-3) with the next higher Alohas CD levels, as described in Table 6, 3.50 grams and then 7.00 grams of the same 3 percent CD solution (Sample 1A) were added to the developer having the previously highest CD level.

To 293.54 grams of the Example VIIB (Sample 7B) liquid toner concentrate (14.308 percent solids) were added 2,499.46 grams of ISOPAR®G (Exxon Corporation) and 7.00 grams of 1:1 Alohas:EMPHOS PS-900™ charge director (Sample 2A) to give a charge director level of 5 milligrams of charge director per gram of toner solids (Control 7B-1 ink). To obtain developers (Controls 7B-2 and 7B-3) with the next higher Alohas:EMPHOS PS-900™ CD levels, as described in Table 7, 7.00 grams and then 14.00 grams of the same 3 percent CD solution (Sample 2A) were added to the developer having the previously highest CD level.

The reflective optical densities in Table 7 at the 2 ips process (paper) speed are equal to or very slightly smaller (almost within the + or −0.02 error margin of the measurement) than the corresponding densities at 1 ips indicating no ROD improvement as a function of process speed for either the Alohas charged inks (Examples VIIA to VIIC) or the Alohas:PS-900 1.5 charged inks (Controls 7A to 7C). However, at the slower 1 ips process speed, the reflective optical densities for the control developers containing Alohas:EMPHOS PS-900™ as the charge director afford higher reflective optical densities than do the experimental developers containing Alohas only as the charge director. In the absence of CCA charging sites and at this low (40 percent) pigment level, there are insufficient cyan pigment surface sites on the toner particles to enable beneficial charging by the Alohas charge director. The absence of an ROD improvement assignable to the Alohas charge director indicates the importance of the toner charging interaction between the Alohas charge director and the charge control agents when both are present.

Sample 7C for Example VIIC-1: Cyan Liquid Toner Concentrate Containing 50 percent of PV FAST BLUE™ and No CCA [27836-102 Toner Conc. for 27803-4-1 ink and 27803-7 Toner Conc. for 27846-16-2 ink][27836-102 Toner Conc.]:

One hundred and thirty-five (135.0) grams of ELVAX 200W® (a copolymer of ethylene and vinyl acetate with a melt index at 190° C. of 2500, available from E.I. DuPont de Nemours and Company, Wilmington, Del.), 135.0 grams of the cyan pigment PV FAST BLUE™ (Hoechst-Celanese), and 405 grams of ISOPAR®L (Exxon Corporation) were added to a Union Process 1S attritor (Union Process Company, Akron, Ohio) charged with 0.1857 inch (4.76 millimeters) diameter carbon steel balls. The mixture was milled in the attritor for 2 hours at 150 rpm while heating the attritor contents at 70° C. to 75° C. by passing steam through the attritor jacket. After the conclusion of the 2 hour attritor hot stage, 675 grams of ISOPAR®G were added to the attritor and cold tap water was passed through the attritor jacket which cooled the attritor contents to about 23° C. The stirring speed of the attritor was maintained at 250 rpm for this 2 hour cold grind period. The dispersion in the attritor was separated from the steel balls by passing the attritor contents through a metal grate, and further rinsing the steel balls with about 300 grams ISOPAR®G to collect residual liquid toner concentrate adhering to the steel balls.

A second batch of cyan liquid toner concentrate was prepared as described above and was combined with the first batch to give Sample 7C. The combined batches of cyan liquid toner concentrate had a toner solids concentration of 16.584 weight percent and was used to formulate the experimental cyan liquid developer (ink) charged with 20/1 Alohas charge director as described in Table 8.

Sample 7D for Control 7C-1: Cyan Liquid Toner Concentrate Containing 50 Percent of PV FAST BLUE™ and No CCA [27803-7 Toner Conc.]

A third, fourth, fifth, and sixth batch of cyan liquid toner concentrate was prepared as described for Sample 7C above. The four batches of cyan liquid toner concentrate were combined to give Sample 7D which had a toner solids concentration of 15.691 weight percent and was used to formulate the control cyan liquid developer (ink) charged with 50/1 Alohas:EMPHOS PS-900™ charge director as described in Table 8.

The cyan liquid developers prepared in Example VII from cyan liquid toner concentrates Samples 7C and 7D contained 50 percent of PV FAST BLUE™ pigment and no charge control agent. The experimental cyan developer was formulated to give 4.0 weight percent of toner solids [(675.35 grams) (0.16584)=112.00 grams of toner solids in 2,800 grams total developer weight] wherein the toner solids include toner resin and pigment. The experimental developer contained 20/1 Alohas charge director (CD) per gram of toner solids and was not bumped up. The control cyan developer was formulated also to give 4.0 weight percent toner solids [(713.78 grams) (0.15691 )=112.00 grams toner solids in 2,800 grams total developer weight] wherein the toner solids include toner resin and pigment. The control developer contained 50/1 Alohas:EMPHOS PS-900™ CD per gram of toner solids and was not bumped up. The experimental charge director was Alohas, as prepared and formulated in Example I (Sample 1C), and the control charge director was Alohas:EMPHOS PS-900™ (Sample 2C).

The print tests for both the experimental and control inks were performed on a Xerox ColorgrafX 8954 electrographic printer set at a contrast of 50 percent (which was equivalent to an input voltage in the range of about 120 to 125 volts) and a paper (Rexham 6262) or process speed of 2 or 4 ips. The toner formulations as well as the reflective optical density (ROD) print test results measured with a Macbeth RD918 Reflectance Densitometer are provided in Table 8. The developers in Table 8 were allowed to stand at ambient conditions for at least 2 days prior to print test evaluation.

TABLE 8

Cyan Developer Formulations - Print Test Results

| Developer No. | Grams of Sample 7C or 7D Toner Concentrate | Grams of Added ISOPAR ® G Carrier Fluid | Total Grams of 3 percent CD Solution | CD Level in mg CD/g Toner Solids | Reflective Optical Density (ROD) at 2 ips | Reflective Optical Density (ROD) at 4 ips |
|---|---|---|---|---|---|---|
| Example VIIC-1 | 675.35 of 7C | 2049.98 | 74.67 | 20/1 | 1.16 | 1.30 |
| Control 7C-1 | 713.78 of 7D | 1899.55 | 186.67 | 50/1 | 1.20 | 1.21 |

To 675.35 grams of the Example VIIC (Sample 7C) liquid toner concentrate (16.584 percent solids) were added 2,049.98 grams of ISOPAR®G (Exxon Corporation) and 74.67 grams of Alohas charge director (Sample 1C) to give a charge director level of 20.0 milligrams charge director per gram of toner solids (Example VIIC-1 ink).

To 713.78 grams of the Example VIIC (Sample 7D) liquid toner concentrate (15.691 percent solids) were added 1,899.55 grams of ISOPAR®G (Exxon Corporation) and 186.67 grams of a 3 weight percent 1:1 Alohas:EMPHOS PS-900™ charge director (Sample 2C) to give a charge director level of 50 milligrams charge director per gram of toner solids (Control 7C-1 ink).

At a faster 4 ips process speed, the Example VIIC-1 cyan developer charged with 20 milligrams of Alohas charge director per gram of toner solids afforded a significantly higher ROD versus the control cyan developer (Control 7C-1) charged with 50 milligrams of Alohas:EMPHOS PS-900™ charge director per gram of toner solids. The higher reflective optical density in Table 8 obtained for the cyan developer charged with the Alohas charge director at a lower level than was used to charge the control cyan developer with 1:1 by weight of Alohas:EMPHOS PS-900™ charge director clearly indicates that the Alohas (alone) charge director is responsible for the increased print densities since no other developer compositional variables or printing variables were changed. At a slower 2 ips process speed, the higher ROD advantage for the Alohas charged cyan developer was lost. Since wide format electrographic color printers are progressing to faster and faster speeds, the higher ROD obtained for the cyan developer charged with 20/1 Alohas charge director at a 4 ips process speed is advantaged over the lower ROD obtained for the cyan developer charged with 50/1 Alohas:EMPHOS PS-900™ (1:1 by weight) charge director at the same 4 ips process speed. In the absence of CCA charging sites, this higher (50 percent) pigment level (versus 35 percent in Example VIIA and 40 percent in Example VIIB) now provides sufficient cyan pigment surface sites on the toner particles to enable higher charging levels by the Alohas charge director and thus higher ROD values. At a 50 percent cyan pigment loading level, the Alohas:EMPHOS PS-900™ charge director is apparently not as able to charge the cyan pigment sites as is the Alohas only charge director and so lower ROD value results for the inks charged with Alohas:EMPHOS PS-900™ even when this charge director is used at a higher loading level.

Other embodiments and modifications thereof of the present invention may occur to one of ordinary skill in the art subsequent to a review of the present application, and these modifications and embodiments, and equivalents thereof are also included with the scope of this invention.

What is claimed is:

1. A positively charged liquid developer comprised of a nonpolar liquid, thermoplastic resin, a cyclodextrin charge control additive, pigment, and a charge director comprised of a nonpolar liquid soluble organic aluminum complex, or mixtures thereof of the formulas

II.

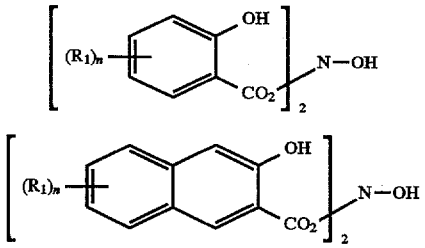

wherein $R_1$ is selected from the group consisting of hydrogen and alkyl, and n represents the number of R substituents.

2. A developer in accordance with claim 1 wherein the charge control additive is beta-cyclodextrin.

3. A developer in accordance with claim 1 wherein alkyl contains from 1 to about 25 carbon atoms.

4. A developer in accordance with claim 1 wherein $R_1$ is methyl, ethyl, propyl, or butyl; and n is 0, 1, 2, 3, or 4.

5. A developer in accordance with claim 1 wherein $R_1$ is isopropyl, n-butyl, isobutyl, or tert-butyl; and n is 0, 1, 2, 3, or 4.

6. A developer in accordance with claim 1 wherein n is 1, 2, 3, or 4.

7. A developer in accordance with claim 1 wherein the charge director aluminum complex is selected from the group consisting of hydroxy bis(3,5-di-tert-butyl salicylic) aluminate, hydroxy bis(3,5-di-tert-butyl salicylic) aluminate monohydrate, hydroxy bis(3,5-di-tert-butyl salicylic) aluminate dihydrate, hydroxy bis(3,5-di-tert-butyl salicylic) aluminate tri- or tetrahydrate, and mixtures thereof.

8. A developer in accordance with claim 1 wherein the aluminum complex is hydroxy bis(3,5-di-tert-butyl salicylic) aluminate.

9. A developer in accordance with claim 1 wherein the thermoplastic resin is ethylene vinyl acetate, the charge control additive is beta-cyclodextrin, and the aluminum complex is hydroxy bis(3,5-di-tert-butyl salicylic) aluminate.

10. A developer in accordance with claim 1 wherein the pigment is carbon black.

11. A developer in accordance with claim 1 wherein the pigment is a cyan pigment, a magenta pigment, a yellow pigment, a red pigment, a blue pigment, a green pigment, or mixtures thereof.

12. A developer in accordance with claim 9 wherein the pigment is carbon black, a cyan pigment, a magenta pigment, a yellow pigment, a red pigment, a blue pigment, a green pigment, or mixtures thereof.

13. A liquid electrostatographic developer in accordance with claim 1 wherein the liquid possesses a viscosity of from about 0.5 to about 20 centipoise and resistivity greater than or equal to about $5\times10^9$; the thermoplastic resin particles possess an average volume particle diameter of from about 0.1 to about 30 microns, and wherein the charge additive is associated with or combined with said resin and said pigment.

14. A developer in accordance with claim 1 wherein the resin is a copolymer of ethylene acrylic acid, a copolymer of a methacrylic acid, a copolymer of an alkyl ester of acrylic acid, a copolymer of an alkyl ester of methacrylic acid, or a copolymer of ethylene and methacrylic acid.

15. A developer in accordance with claim 1 wherein the cyclodextrin is alpha, beta or gamma cyclodextrin.

16. A developer in accordance with claim 1 wherein the pigment is present in an amount of about 0.1 to 60 percent by weight based on the total weight of the developer solids of resin, pigment, and charge control additive.

17. A developer in accordance with claim 1 with a solids content of from about 1 to about 5 weight percent, and which solids are comprised of thermoplastic resin, pigment, and charge control additive, and wherein said pigment is present in an amount of from about 35 to about 50 weight percent based on the weight percent of toner solids; the resin is present in an amount of from about 50 to about 65 weight percent based on the weight percent of toner solids; and the cyclodextrin is present in an amount of from about 5 to about 10 weight percent based on the weight percent of toner solids.

18. A developer in accordance with claim 1 wherein the liquid is an aliphatic hydrocarbon.

19. A developer in accordance with claim 18 wherein the aliphatic hydrocarbon is a mixture of branched hydrocarbons with from about 12 to about 20 carbons atoms, or wherein the aliphatic hydrocarbon is a mixture of normal hydrocarbons of from about 10 to about 20 carbon atoms.

20. A developer in accordance with claim 1 wherein there is further included a charge adjuvant of aluminum stearate.

21. An imaging method which comprises forming an electrostatic latent image followed by the development thereof with the liquid developer of claim 1.

22. A developer in accordance with claim 1 wherein said resin is ethylene vinyl acetate, the charge control additive is beta-cyclodextrin, and the charge director is hydroxy bis(3,5-di-tert-butyl salicylic) aluminate.

23. A developer in accordance with claim 1 wherein the charge control additive is N,N-diethylamino-N-2-ethyl substituted beta cyclodextrin, or N,N,N-trimethyl-N-2-hydroxypropyl ammonium chloride substituted beta cyclodextrin.

24. A developer in accordance with claim 1 wherein the thermoplastic resin is ethylene vinyl acetate, the aluminum complex is hydroxy bis(3,5-di-tert-butyl salicylic) aluminate, and the charge control additive is N,N-diethylamino-N-2-ethyl substituted beta cyclodextrin, or N,N,N-trimethyl-N-2-hydroxypropyl ammonium chloride substituted beta cyclodextrin.

25. A positively charged liquid developer comprised of a nonpolar liquid, thermoplastic resin, a charge control additive of copolymers or homopolymers of ethylene oxide and propylene oxide, pigment, and a charge director comprised of a nonpolar liquid soluble organic aluminum complex, or mixtures thereof of the formulas

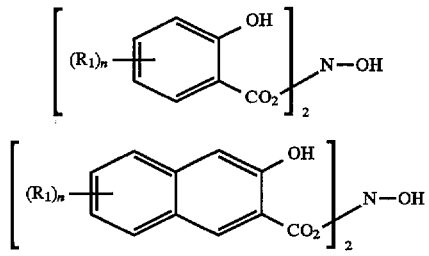

II.

wherein $R_1$ is selected from the group consisting of hydrogen and alkyl, and n represents a number.

* * * * *

UNITED STATES PATENT AND TRADEMARK OFFICE

CERTIFICATE OF CORRECTION

PATENT NO. : 5,672,456

DATED : September 30, 1997

INVENTOR(S) : Scott D. Chamberlain, David H. Pan, John W. Spiewak

It is certified that error appears in the above-indentified patent and that said Letters Patent is hereby corrected as shown below:

In the Abstract; column 1, lines 45 to 55; column 33, lines 55 to 65 in Claim 1, and in column 36, lines 10 to 20 in Claim 25, delete the formula and insert the formula below:

II.

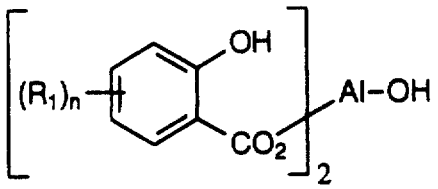

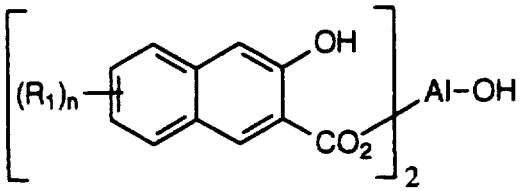

Signed and Sealed this

Twenty-third Day of June, 1998

*Attest:*

Bruce Lehman

BRUCE LEHMAN

*Attesting Officer*

*Commissioner of Patents and Trademarks*